US007563142B1

(12) United States Patent
Wenger et al.

(10) Patent No.: US 7,563,142 B1
(45) Date of Patent: Jul. 21, 2009

(54) MEDICAL DEVICE PACKAGING SYSTEMS INCLUDING ELECTRICAL INTERFACES

(75) Inventors: William K. Wenger, St. Paul, MN (US); Christine G. Kronich, St. Paul, MN (US); Gerald Jordan Montgomery, Blaine, MN (US)

(73) Assignee: Medtronic, Inc., Minneapolis, MN (US)

( * ) Notice: Subject to any disclaimer, the term of this patent is extended or adjusted under 35 U.S.C. 154(b) by 0 days.

(21) Appl. No.: 12/112,090

(22) Filed: Apr. 30, 2008

(51) Int. Cl.
*H01R 24/04* (2006.01)

(52) U.S. Cl. ..... 439/669; 607/37

(58) Field of Classification Search ..... 607/37, 607/115, 116, 119; 439/669, 668, 909, 191, 439/700

See application file for complete search history.

(56) References Cited

U.S. PATENT DOCUMENTS

| | | | | |
|---|---|---|---|---|
| 5,314,430 | A * | 5/1994 | Bardy | 607/5 |
| 6,335,492 | B1 | 1/2002 | Terasaka et al. | |
| 6,361,372 | B1 * | 3/2002 | Chiang | 439/680 |
| 6,968,235 | B2 * | 11/2005 | Belden et al. | 607/60 |
| 7,130,699 | B2 * | 10/2006 | Huff et al. | 607/116 |
| 7,289,855 | B2 * | 10/2007 | Nghiem et al. | 607/60 |
| 7,322,832 | B2 * | 1/2008 | Kronich et al. | 439/67 |
| 2003/0068914 | A1 | 4/2003 | Merry et al. | |
| 2004/0093038 | A1 * | 5/2004 | Biggs et al. | 607/37 |
| 2004/0147822 | A1 | 7/2004 | Al-Ali et al. | |
| 2004/0230267 | A1 | 11/2004 | Wenger | |
| 2006/0144747 | A1 | 7/2006 | Le et al. | |
| 2007/0123947 | A1 | 5/2007 | Wenger et al. | |
| 2007/0179555 | A1 * | 8/2007 | Iyer et al. | 607/37 |
| 2007/0213781 | A1 * | 9/2007 | Fruland et al. | 607/37 |

* cited by examiner

*Primary Examiner*—Michael C Zarroli
*Assistant Examiner*—Harshad C Patel

(57) ABSTRACT

An electrical interface includes a contact surface and a connector structure supporting the contact surface for electrical coupling with an electrical contact of a medical device, which device is contained within a package. The electrical interface facilitates coupling of the electrical contact of the packaged medical device to an electrical contact of another medical device, which is located outside the package. If the electrical contact of the packaged device is mounted within a bore of the device, then the connector structure allows for passage of a sterilizing gas into the connector bore, and past the connector contact, within the bore.

36 Claims, 11 Drawing Sheets

MEDICAL DEVICE PACKAGING SYSTEMS INCLUDING ELECTRICAL INTERFACES

TECHNICAL FIELD

The present disclosure pertains to medical devices and more particularly to medical device packaging systems.

CROSS REFERENCE TO RELATED APPLICATION

Reference is made to commonly-assigned and co-pending application U.S. Ser. No. 12/112,095, filed Apr. 30, 2008, entitled "Lead-Implant Coupling Device;" U.S. Ser. No. 12/112,102, filed Apr. 30, 2008, entitled "Remote Lead-Implant Coupling Device;" and U.S. Ser. No. 12/112,111, filed Apr. 30, 2008, entitled "Lead Implant System," all of which are herein incorporated by reference in their entirety.

BACKGROUND

Many medical devices, particularly implantable medical devices, are provided, in sterilized packages. Such packaging typically includes a relatively rigid tray, for example, a thermoformed plastic tray, to hold the device, and a lid, for example, formed from Tyvek® (DuPont™), which is sealed about a perimeter of the tray and forms a relatively light weight, durable and selective barrier between the inside and outside of the tray; the lid may be peeled away to provide an opening through which the device may be dropped into a sterile field, without compromising the sterility of the device or the sterile field.

For medical systems that include more than one device, it is often necessary to evaluate a first device of the system prior to connecting the first device to another one or more devices of the system, which may be packaged in separate sterile packages. An exemplary system includes an implantable generator device and an implantable electrical lead, which couples the generator device to a body of a patient. Those skilled in the art are familiar with various types of implantable systems, ranging from cardiac and neurological stimulators to diagnostic pressure sensors, whose performance relies upon an effective interface between the one or more electrical leads of the system and a particular site within the body of the patient. To determine whether or not an effective interface can be attained as well as to verify the operability of the leads, it is prudent to evaluate the interface between the one or more leads and the patient's body, at one or more implant sites, using a "dummy" generator device, or what is typically called an analyzer. Using the analyzer, rather than the sterilized generator device, for pre-implant testing, can prevent an unnecessary removal of the device from its sterile packaging, if an effective interface between the one or more leads and the body cannot be attained. However, electronic circuitry of an analyzer may differ from that of an actual implantable generator device so that, in some situations, signals measured by the analyzer can differ enough from those measured by the actual device so as to limit the usefulness of the evaluation performed with the analyzer.

BRIEF DESCRIPTION OF THE DRAWINGS

The following drawings are illustrative of particular embodiments of the present disclosure and therefore do not limit the scope of the disclosure. The drawings (not to scale) are intended for use in conjunction with the explanations in the following detailed description, wherein like numerals denote like elements.

DETAILED DESCRIPTION

The following detailed description is exemplary in nature and is not intended to limit the scope, applicability, or configuration of the present disclosure in any way. Rather, the following description provides practical illustrations for implementing exemplary embodiments of the present disclosure. Examples of constructions are provided for selected elements, and all other elements employ that which is known to those of skill in the field of the present disclosure. Commonly assigned and co-pending U.S. patent application 2007/0123947, entitled MEDICAL DEVICE PACKAGING SYSTEM, which is hereby incorporated by reference in its entirety, describes various embodiments of electrical interfaces for packaged medical devices, that are useful for electrically coupling an implantable generator device to a patient's body without breaching the package, which contains the generator device, thereby maintaining the sterility of the device during pre-implant testing. However, there is still a need for new types of electrical interfaces, which accommodate alternative electrical couplings with packaged implantable generator devices without compromising the sterility of the devices.

Figure 1:
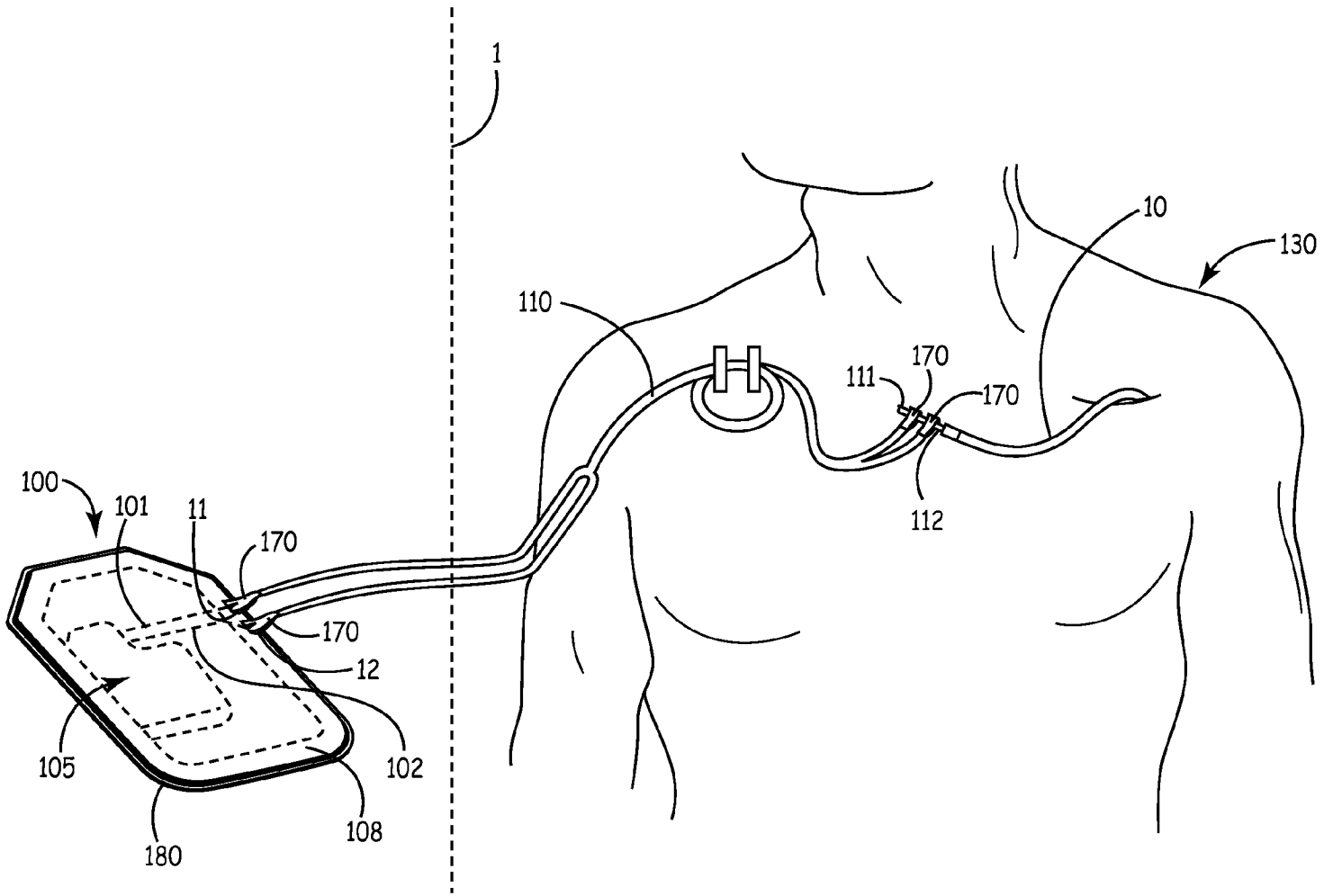
FIG. 1 is a schematic overview of a system, according to some embodiments of the present disclosure, which is coupled for pre-implant testing to an implanted electrical lead.
Figure 2:
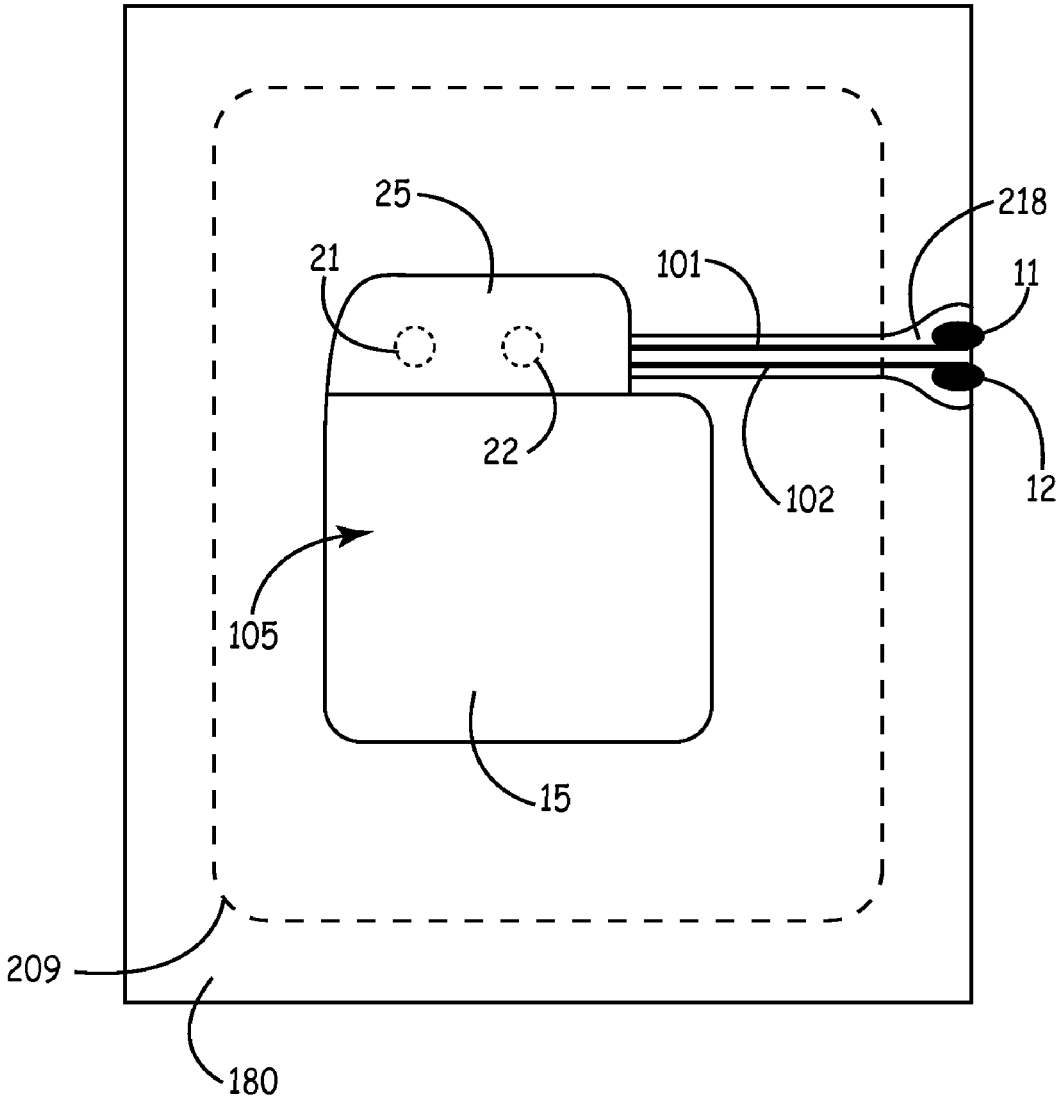
FIG. 2 is an enlarged plan view of a portion of the system shown in FIG. 1, according to some embodiments.

FIG. 1 is a schematic overview of a system 100, according to some embodiments of the present disclosure, coupled for pre-implant testing to an implanted electrical lead 10; and FIG. 2 is an enlarged plan view of a portion of system 100, according to some embodiments. FIG. 1 illustrates, within a border 1 of a sterile field, a patient 130, in which lead 10 is implanted, and system 100 outside border 1 of the sterile field; a sterile connection cable 110 is shown crossing border 1 to electrically couple lead 10 to system 100. FIG. 1 further illustrates system 100 including a sterile package, which is formed by a tray 180 and a lid 108, sealed thereover, an implantable generator device 105 (shown with dashed lines), which is enclosed within tray 180, beneath lid 108, and a portion of an electrical interface formed by conductive leads 101, 102 (also shown with dashed lines) and contact surfaces 11, 12; leads 101, 102 are shown extending from device 105, which is contained within the package, to contact surfaces 11, 12, which are located on an exterior side of lid 108 in proximity to an outer perimeter of tray 180. Tray 180 may be a thermoformed plastic, for example, high density polyethylene (an exemplary profile of a cavity of tray 180 may be seen in FIG. 7A), and lid 108 may be formed from TYVEK®. FIG. 2 illustrates tray 180 with lid 108 removed to show the substrate 218 of the electrical interface, which crosses through a seal zone 209 (shown with dashed lines) between lid 108 and tray 180, and along which conductive leads 101, 102 extend. Contact surfaces 11, 12 are shown terminating conductive leads 101, 102, on substrate 218 at an edge of tray 180.

Substrate 218 may be a flexible insulative substrate, for example, formed from a DuPont™ KAPTON® polyimide film, on which leads 101, 102 and contact surfaces 11, 12, for example, formed by a conductive ink, are printed, for example, in a flex circuit fashion. Alternatively, leads 101, 102 and contact surfaces 11, 12 may be formed from conductive wires, foils, films or tapes, which are laminated, or otherwise adhered to substrate 218. Although not explicitly shown, it should be appreciated that substrate 218 may extend beneath leads 101, 102 and contact surfaces 11, 12, on a side of tray 180, and, a dielectric, or insulative layer, for example, formed from polyurethane, may extend over leads 101, 102 and contact surfaces 11, 12 on an opposite side thereof, adjacent to lid 108; such an insulative layer may promote better adhesion between lid 108 and the portion of the electrical interface that extends through seal zone 209.

According to the illustrated embodiment, with reference back to FIG. 1, each end of connection cable 110 includes a pair of alligator clips 170 for making electrical connection with contacts 11, 12 and with lead connector contacts 111, 112. With further reference to FIG. 2, it will be appreciated that the electrical interface electrically couples electrical contacts 21, 22 of device 105 via conductive leads 101, 102, to contact surfaces 11, 12, as will be described in greater detail below, so that cable 110 electrically couples lead 10 to device 105 without having to remove device 105 from the package, or to peel back lid 108 from tray 180. Alternative embodiments to the portion of the electrical interface, which is shown in FIG. 2, will be described in greater detail below, in conjunction with FIGS. 7A-D and 8A-C.

Figure 3B:
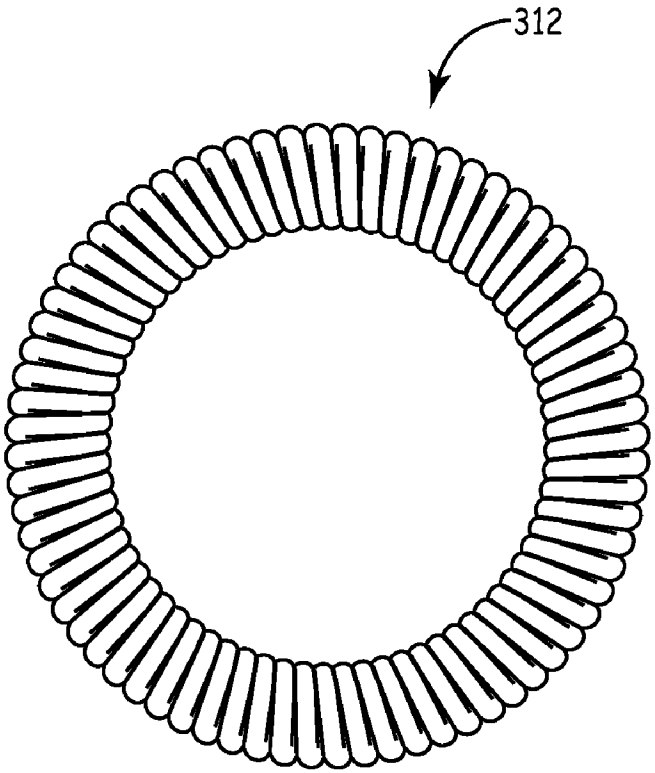
FIG. 3B is a plan view of an alternative electrical contact, which may be incorporated with a connector bore of an implantable generator device.
Figure 3A:
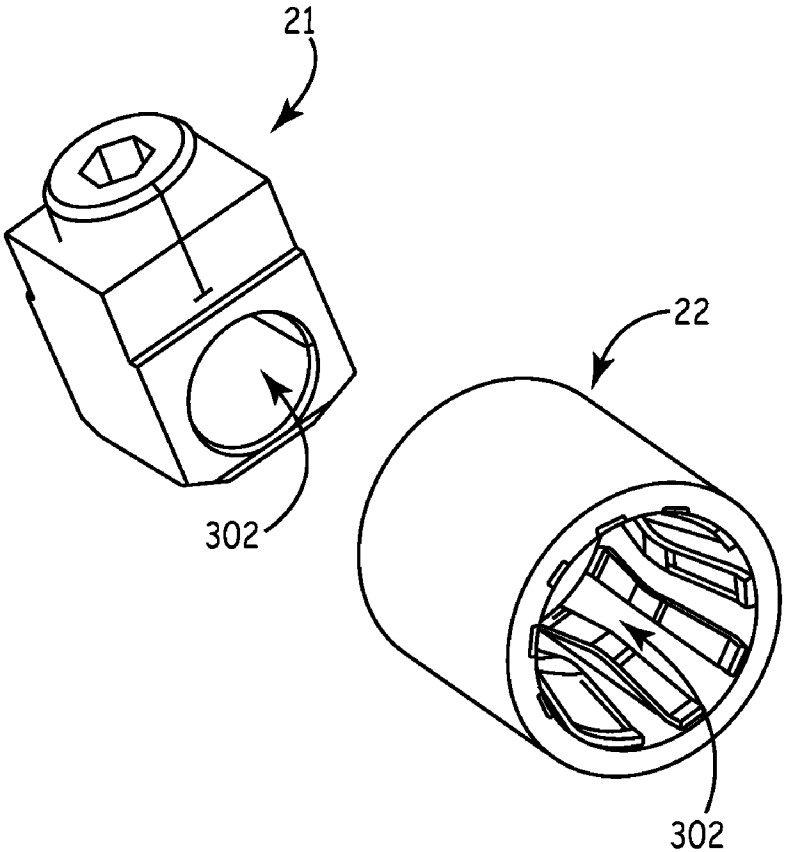
FIG. 3A is a perspective view of two types of electrical contacts that may be incorporated within a single connector bore of an implantable generator device.

FIG. 2 further illustrates device 105 including a can, or housing 15, for example, which encloses a battery and electronic circuitry, and a connector module 25, having a bore (not shown) in which connector contacts 21, 22 (schematically depicted) are mounted for electrically coupling with a lead connector, according to methods known to those skilled in the art. Examples of connector contacts 21, 22 are illustrated in FIG. 3A, as they may be arranged within the bore of module 25, longitudinally spaced apart from one another and having their bores 302 extending approximately coaxially with the bore of module 25. An alternative connector contact 312, which may be substituted for either of contacts 21, 22 is shown in FIG. 3B. Contact 21 is shown as a set screw type contact, contact 22 as a multi-beam type contact, and contact 312 as a garter spring-type contact. With reference back to FIG. 2, it may be appreciated that each of the other contact surfaces of the electrical interface, which are not shown, are positioned to make electrical contact with contacts 21, 22, inside the bore of module. According to embodiments of the present disclosure, a connector structure of the electrical interface, which supports these other contact surfaces, within the bore of device 105, is constructed so as to allow a passage of a sterilizing gas, for example, ethylene oxide (EtO) gas, into the bore of device 105, when system 100 is sterilized, in order to ensure complete sterility of device 105. Various embodiments of connector structures for electrical interfaces will now be described in conjunction with FIGS. 4-6.

Figure 4B:
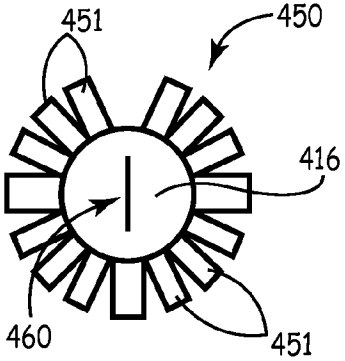
FIGS. 4A-B are plan and end views, respectively, of an electrical interface, according to some embodiments of the present disclosure.
Figure 4A:
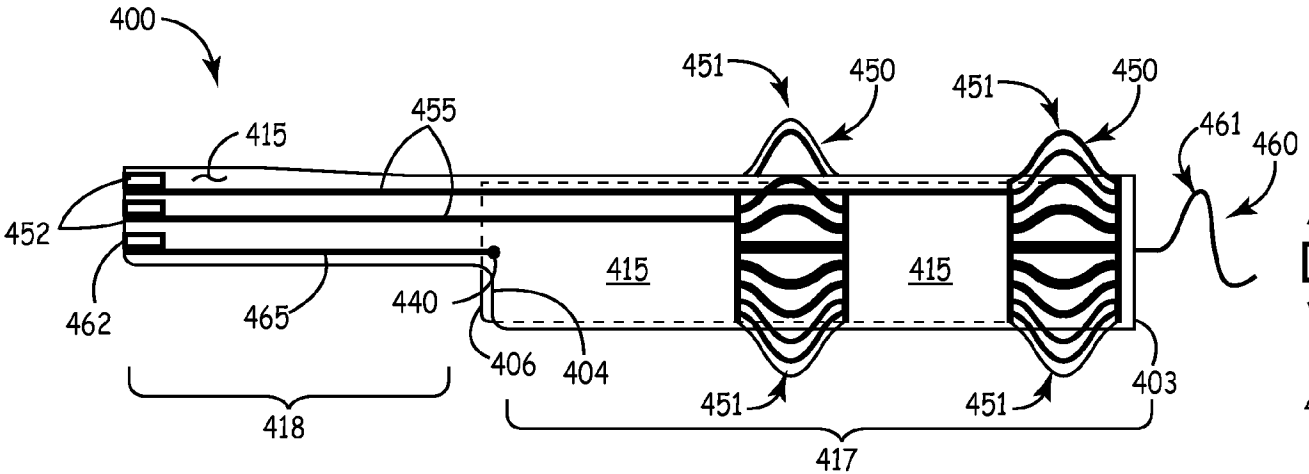
Figure 4C:
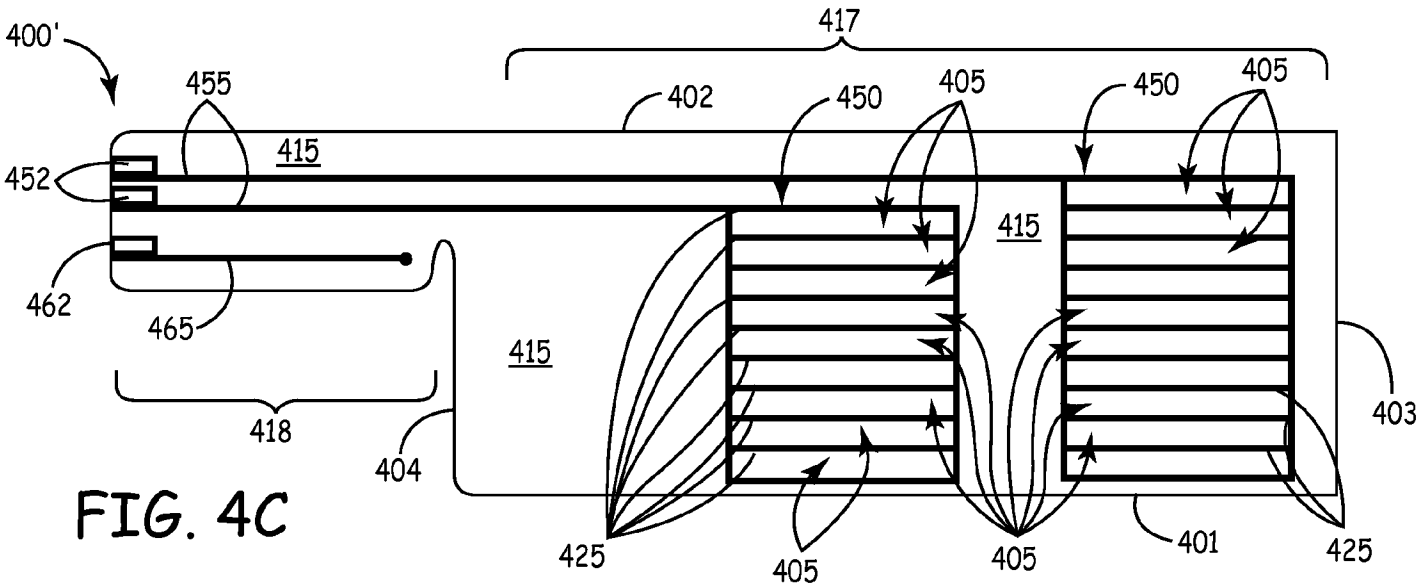
FIG. 4C is a plan view of a portion of the electrical interface of FIGS. 4A-B in a pre-assembled form, according to some embodiments.

FIGS. 4A-B are plan and end views, respectively, of an electrical interface 400, according to some embodiments of the present disclosure. FIG. 4A illustrates a relatively thin and flexible substrate 415 forming a portion of interface 400 and including a tubular first part 417 and a relatively flat second part 418. FIGS. 4A-B illustrate tubular first part 417 being wrapped about a pin member 416 of interface 400 and including a pair of segments, which are each deformed into a plurality of protruding curved beams 450, according to some embodiments of the aforementioned connector structure. With reference to FIG. 4C, which illustrates first portion 417 in a relatively flat, pre-assembled form, each of the plurality of beams 450 is separated by a cut-out portion, or slit 405 in substrate 415, and bears a conductive trace 425 with each conductive trace 425 extending to a corresponding conductive lead 455. Each lead 455 extends along first portion 417 of substrate 415 to second portion 418 of substrate 415 to couple traces 425 to corresponding contact surfaces 452, which are mounted to second portion 418. Although each of the plurality of beams 450 are shown bearing a conductive trace 425, it should be noted that embodiments of the present disclosure are not so limited and any number of beams of each plurality 450 may bear a trace 425. Microflex, or miniature-scale micro-circuit technology may be employed to apply the traces to, and form the slits in substrate 415.

According to the illustrated embodiment, opposing edges 401, 402 of first portion 417 of substrate 415 are coupled at the seams around pin member 416, and then an end 403 of substrate 415 may be pushed toward an opposing end 404 in order to deform, or buckle, the beams of each plurality of beams 450 so that an apex of each curved beam, that bears conductive trace 425, forms one of contact surfaces 451, as shown in FIGS. 4A-B. The maximum dimension of an outer perimeter of each plurality of protruding beams 450 is tailored to be sufficiently large so that contact surfaces 451 mate within a bore of a particular electrical contact, with sufficient rigidity to maintain a stable electrical contact between each contact surface 451 and the corresponding electrical contact, while maintaining a position of each apex in proximity to a sidewall of the connector bore so as to provide a space beneath each beam. The space provided by this connector structure allows for passage of a sterilizing gas within a connector bore and past the electrical contacts mounted therein of a packaged device.

FIGS. 4A-B further illustrate electrical interface 400 including another contact surface 461, which is formed at an apex of a relatively rigid, curved and protruding beam 460, which extends proximally from pin member 416 and may be formed integrally therewith, according to some embodiments of the aforementioned connector structure. According to the illustrated embodiment, contact surface 461 is electrically coupled to another contact surface 462, which is mounted alongside contact surface 452 on second part 418 of substrate 415, via pin member 416 and another conductive lead 465. Pin member 416 may be formed from stainless steel. FIG. 4A illustrates a distal end 404 of pin member 416 coupled to conductive lead 465 at a connective interface 440. The pair of plurality of beams 450 are shown longitudinally spaced apart from one another, and from beam 460, so as to each be located for electrical coupling with a corresponding electrical contact, for example, any of contacts 21, 22, 312 (FIGS. 3A-B), within a bore of a connector module of a generator device, when electrical interface 400 is assembled together with the device inside a package for sterilization. (Although the previously depicted device 105 was described as including only a pair of electrical contacts 21, 22 mounted within the bore of module 25, it should be appreciated that such a device may include a connector bore that includes three electrical contacts mounted therein for mating with each of the contact surfaces 451, 461 of electrical interface 400.) According to alternate embodiments, curved beam 460 may only function to provide positional stability within a connector bore so that the apex of beam 460 interfaces non-conductively with a sidewall within the connector bore, in which case beam 460 and pin member 416 may be formed from a non-conductive material and conductive lead 465, along with contact surface 462, are absent from interface 400.

With yet further reference to FIG. 4A, in conjunction with FIG. 2, it may be appreciated that second portion 418 of substrate 415 is dimensioned to extend through a package, which contains the device to which contact surfaces 451, 461 are electrically coupled, from within the package, so that contact surfaces 452, 462 may be positioned on an exterior side of the package, similar to contact surfaces 11, 12. According to some alternate embodiments, an entirety of electrical interface 400 is contained within the package such that contact surfaces 452, 462 are located within the package for coupling with an auxiliary portion of the electrical interface, which auxiliary portion may be formed on a side wall of the package for direct coupling with contact surfaces 452, 462, for example, similar to the embodiment described below in conjunction with FIG. 7A; alternatively, the auxiliary portion further includes a connective interface such as is described in greater detail below, in conjunction with FIG. 7D.

Figure 5:
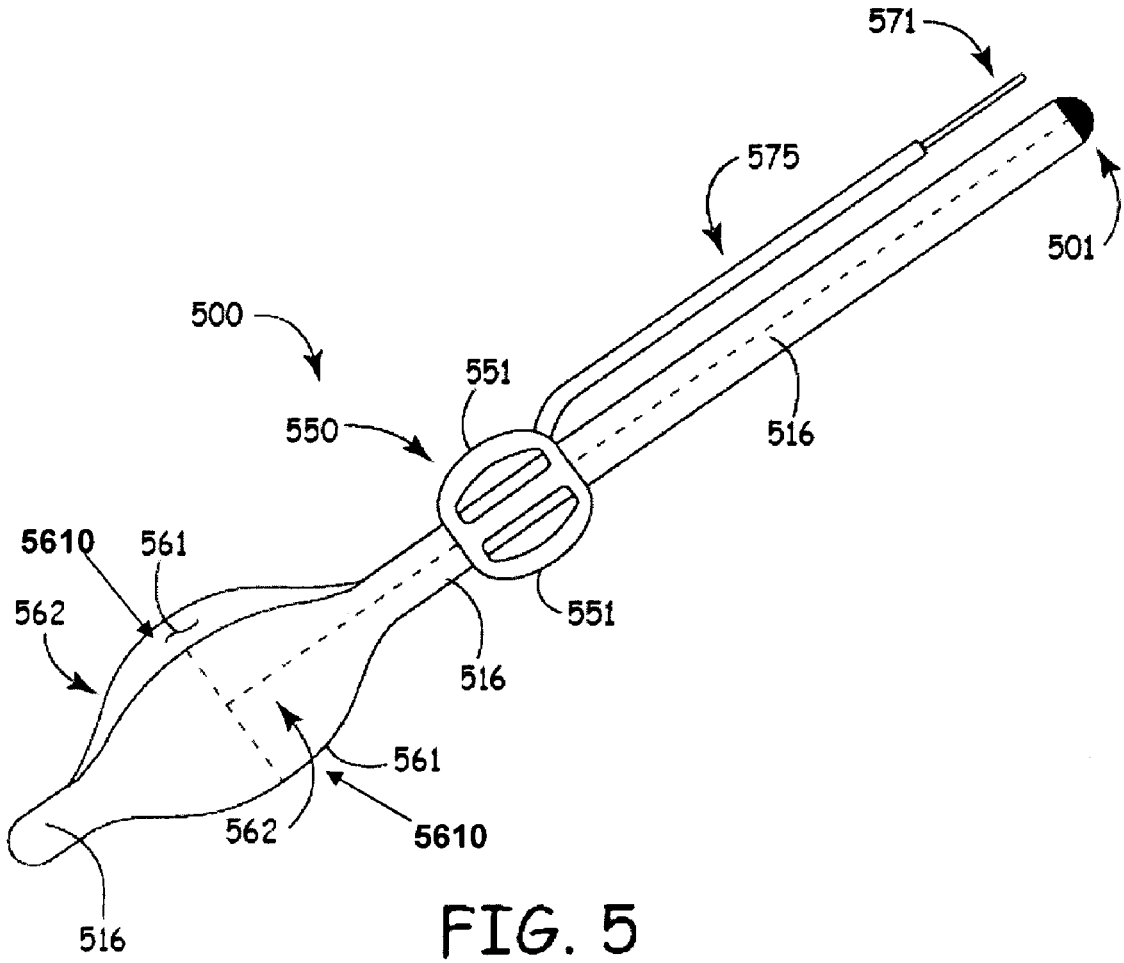
FIG. 5 is a perspective view of a connector portion for an electrical interface, according to some additional embodiments of the present disclosure.

FIG. 5 is a perspective view of a connector portion 500 for an electrical interface, according to some alternate embodiments of the present disclosure. FIG. 5 illustrates connector portion 500 including a pin member 516 and a plurality of protruding beams 550 arranged about pin member 516, according to some embodiments of the aforementioned connector structure. According to the illustrated embodiment, pin member 516 also includes a connector structure formed by a pair of approximately flattened sides 562, which oppose one another and extend between a pair of arching sides 5610; each arching side 5610 includes a contact surface 561 that is electrically coupled to a distal end 501 of pin member 516, which distal end 501 forms a contact surface for coupling to a remainder of the electrical interface, for example, as will be described below, in conjunction with FIGS. 7A-C. FIG. 5 further illustrates additional contact surfaces 551, located at an apex of a corresponding beam of the plurality of beams 550. An insulated conductor 575 is coupled to the contact surfaces 551 and extends to a distal end 571. The distal end 571 has a contact surface for coupling to a remainder of the electrical interface, for example, as will also be described below, in conjunction with FIGS. 7A-C. With reference back to FIG. 4A, it may be appreciated that the connector structure associated with contact surfaces 551 is similar in form to that associated with contact surfaces 451.

A bulk of pin member 516 may be formed from a conductive material, for example, stainless steel, so that contact surfaces 561 are integral with the bulk of pin member 516 and an insulating layer, for example, formed by a fluoropolymer or polyimide coating formed on pin member 516, may be necessary to isolate beams 550 from pin member 516; or, the bulk of pin member 516 may be formed from an insulative material, for example, polyetheretherketone (PEEK), so that conductive surfaces 561 are attached to arching sides and coupled to a conductor, shown with a dashed line, which is embedded within the bulk of pin member 516 and extends from contact surfaces 561 to distal end 501 in order to couple contact surfaces 561 to distal end 501.

Figure 6:
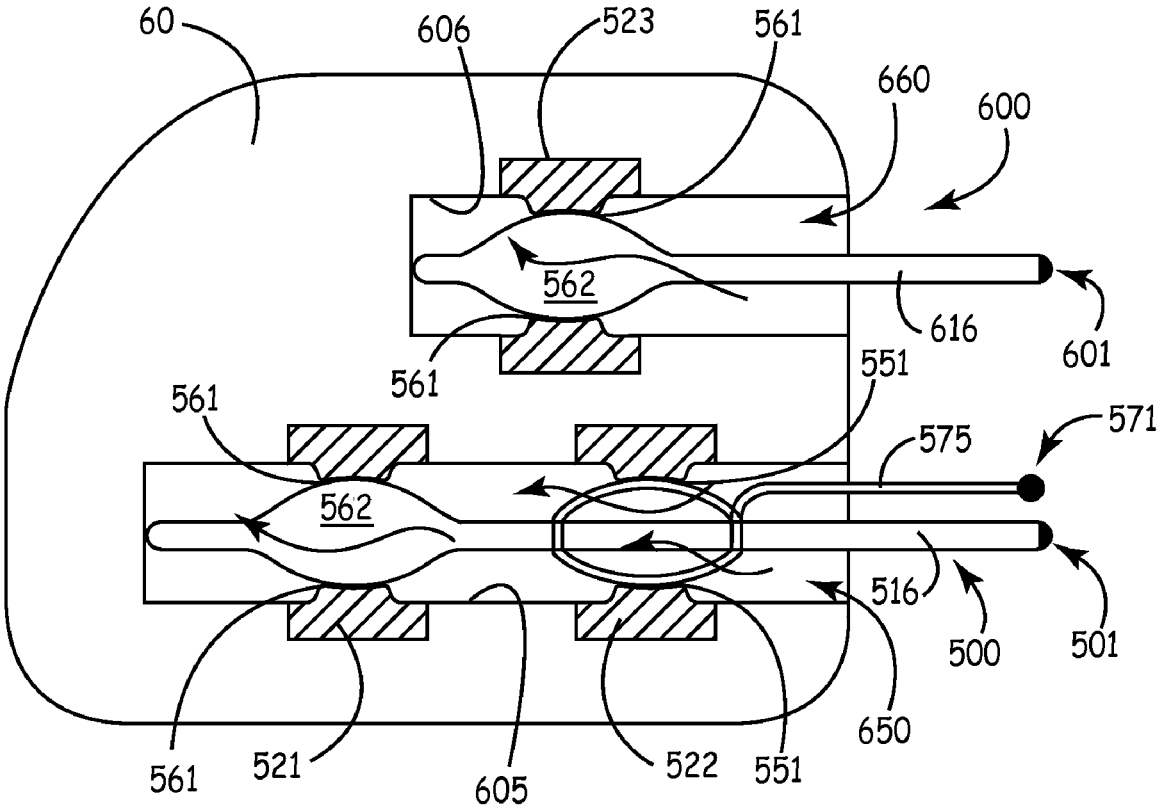
FIG. 6 is a schematic section view through a connector module of an implantable generator device, to which a pair of connector portions, according to some embodiments of the present disclosure, are electrically coupled.

Turning now to FIG. 6, which is a schematic section view through a pair of connector bores 650, 660 of a connector module 60 of an implantable generator device 705 (FIG. 7A), an electrical coupling of connector portion 500 and another connector portion 600, within bores 650 and 660, respectively, according to some embodiments of the present disclosure, will be described. FIG. 6 illustrates connector bore 650 including two spaced apart electrical contacts 521, 522 mounted within a sidewall 605 thereof, and connector bore 660 including a single electrical contact 523 mounted within a sidewall 606 thereof. Contacts 521, 522, 523 may be any of the contacts 21, 22, 312 depicted in FIGS. 3A-B. It should be noted that connector portion 600 includes a pin member 616, which is formed into a connector structure supporting contact surfaces 561, for connector portion 500; a bulk of pin member 616 is preferably conductive, for example, formed from stainless steel, and includes a distal end 601 serving as another contact for electrical coupling to a remaining portion of the electrical interface.

According to the illustrated embodiment, connector portion 500 is inserted into bore 650, such that contact surfaces 561 and 551 are electrically coupled to electrical contact 521 and 522, respectively; and, connector portion 600 is inserted into bore 660, such that contact surfaces 561 are electrically coupled to electrical contact 523. Arrows shown within each bore 650, 660 schematically depict a flow of sterilizing gas, which is allowed passage past each of electrical contacts 521, 522, 523, by the spaces in the corresponding connector structures, between each beam of plurality of beams 550, and spaces between approximately flattened surfaces 562.

Figure 7A:
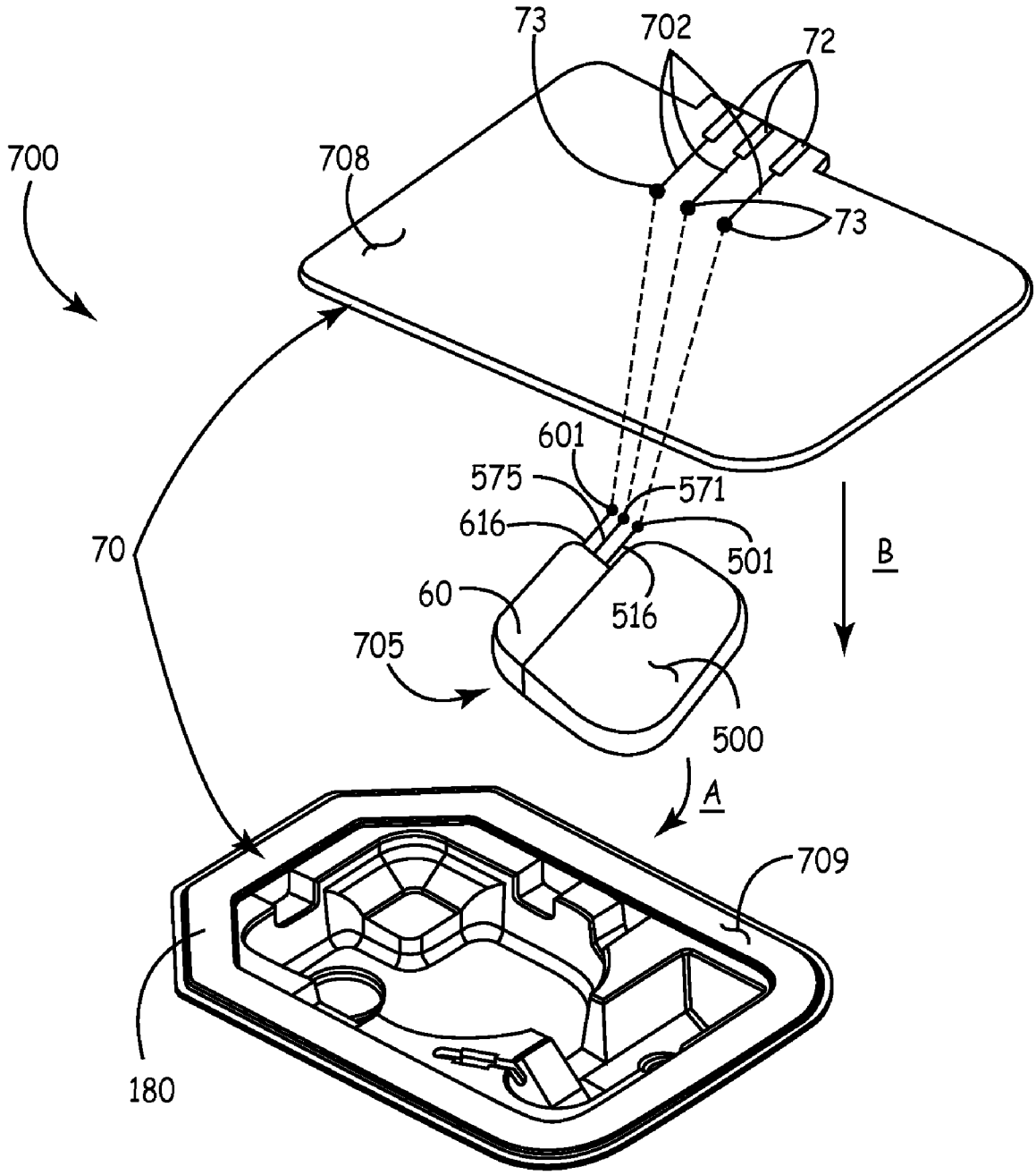
FIG. 7A is an exploded perspective view of a system including an electrical interface, according to some other embodiments of the present disclosure.

According to some embodiments of the present disclosure, distal ends 501, 571, 601 of connector portions 500, 600 are connected to the remaining portion of the electrical interface to complete an electrical coupling between contact surfaces 551, 561 and corresponding contact surfaces, which are located on an exterior surface of a package 70 containing generator device 705 (FIG. 7A). According to some embodiments, for example, as depicted in FIG. 7A, distal conductive leads 702, internal contact surfaces 73 and external contact surfaces 72 form the remaining portion of the electrical interface. Leads 702, which are formed along a side wall or lid 708 of a package 70, each couple a corresponding pair of contact surfaces 72, 73 to one another. Each contact surface 73 is positioned to directly couple a corresponding end 501, 571, 601 to a corresponding external contact surface 72 mounted on lid 708, near a perimeter of tray 180.

FIG. 7A is an exploded perspective view of a system 700 including package 70, device 705 and the electrical interface formed by connector portions 500, 600 (FIG. 6) and lid 708 of package 70. According to the illustrated embodiment, tray 180 includes a cavity into which device 705 is placed, per arrow A; the cavity of tray 180 has a profile to hold device 705 in a position so that ends 501, 571, 602 are each located, and maintained in that location, for mating with the corresponding contact surface 73, when lid 708 has been placed over device 705, in tray 180, per arrow B, and has been sealed to tray 180 along a seal zone 709. Lid 708 is preferably formed from TYVEK®, or a similar material, and contact surfaces 73 and conductive leads 702 may be printed or laminated to an inner surface of lid 708 (although shown, with lines, along an outer surface, for ease of illustration); contact surfaces 72 may similarly be printed or laminated to lid 708 and may extend from leads on an inner surface to wrap around an edge of lid to the outer surface thereof, as illustrated. With reference back to FIG. 1, it may be appreciated that a connector, for example, alligator clips, of a connection cable that is coupled to an implanted lead, for example, cable 110 coupled to lead 10, may be coupled to each contact 72 of system 700 in order to electrically couple device 705 to the implanted lead for electrical testing, without having to remove device 705 from package 70.

Figure 7B:
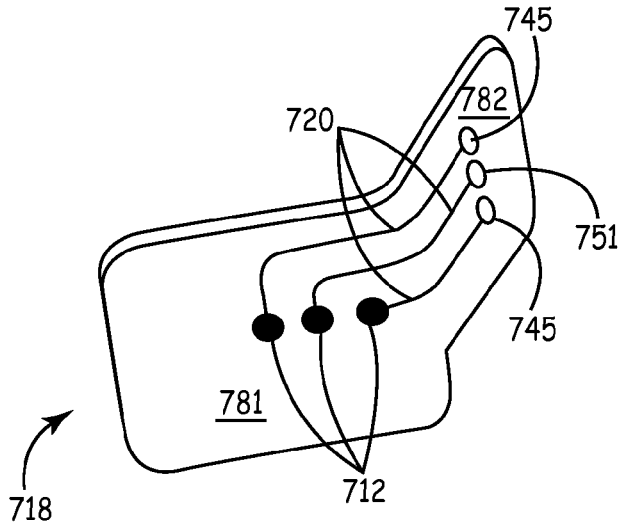
FIG. 7B is a perspective view of a portion of an electrical interface, according to yet further embodiments.

FIG. 7B is a perspective view of connective interface 718 which may be included in the electrical interface shown in FIG. 7A, according to some alternate embodiments. FIG. 7B illustrates interface 718 including a relatively thin and flexible substrate divided into a first segment 781 and a second segment 782, wherein second segment 782 is bent away from first segment 781; three contact surfaces 712 are shown being formed on first segment 781, as well as corresponding conductive leads 720 extending therefrom, along first segment 781 to second segment 782, and along second segment 782. FIG. 7B further illustrates two conductive apertures 745 formed in second segment 782, wherein each one is coupled to a corresponding conductive lead 720, and terminal end 751 of another of the conductive leads 720 located on second segment 782.

Figure 7C:
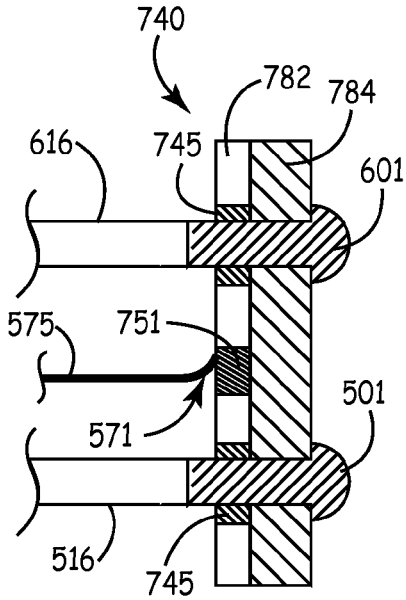
FIG. 7C is an enlarged section view through a segment of the portion of the electrical interface shown in FIG. 7B, in combination with the connector portions of FIG. 6.

According to the illustrated embodiment, apertures 745 and terminal end 751 provide conductive surfaces which are oriented for electrical coupling with distal ends 501, 571, 601 of connector portions 500, 600, for example as illustrated in FIG. 7C; and contact surfaces 712 are disposed on first segment 781, which is oriented to be 'sandwiched' between a surface 715 of device 705 and lid 708 in order to provide for electrical coupling with contact surfaces 73, which are formed on lid 708 (FIG. 7A).

FIG. 7C is an enlarged section view through second segment 782 of connective interface 718, in combination with connector portions 500, 600 (FIG. 6), which are coupled thereto. FIG. 7C illustrates the contact surfaces of apertures 745, each being formed by a conductive lining, for example, formed via plating, and distal ends 501, 601 of each of pin members 516, 616 extending through a corresponding aperture 745, and through an optional backing member 784 (serving as a stiffener), and being deformed to have a mushroom-like cap in order to secure the contact surfaces of ends 501, 601 within conductive apertures 745. Backing member 784 may be formed from a relatively rigid plastic. FIG. 7C further illustrates the contact surface of distal end 571 of conductor 575 (part of connector portion 500) being coupled, for example, via soldering, to terminal end 751. With reference back to FIG. 6, it can be seen that connector portions 500, 600 extend from respective bores 650, 660, so that respective distal ends 501, 571 and 601 are spaced away from each bore entry; thus second segment 782 of connective interface 718, as illustrated in FIG. 7C, will not block sterilizing gas from entering into bores 650, 660.

Figure 7D:
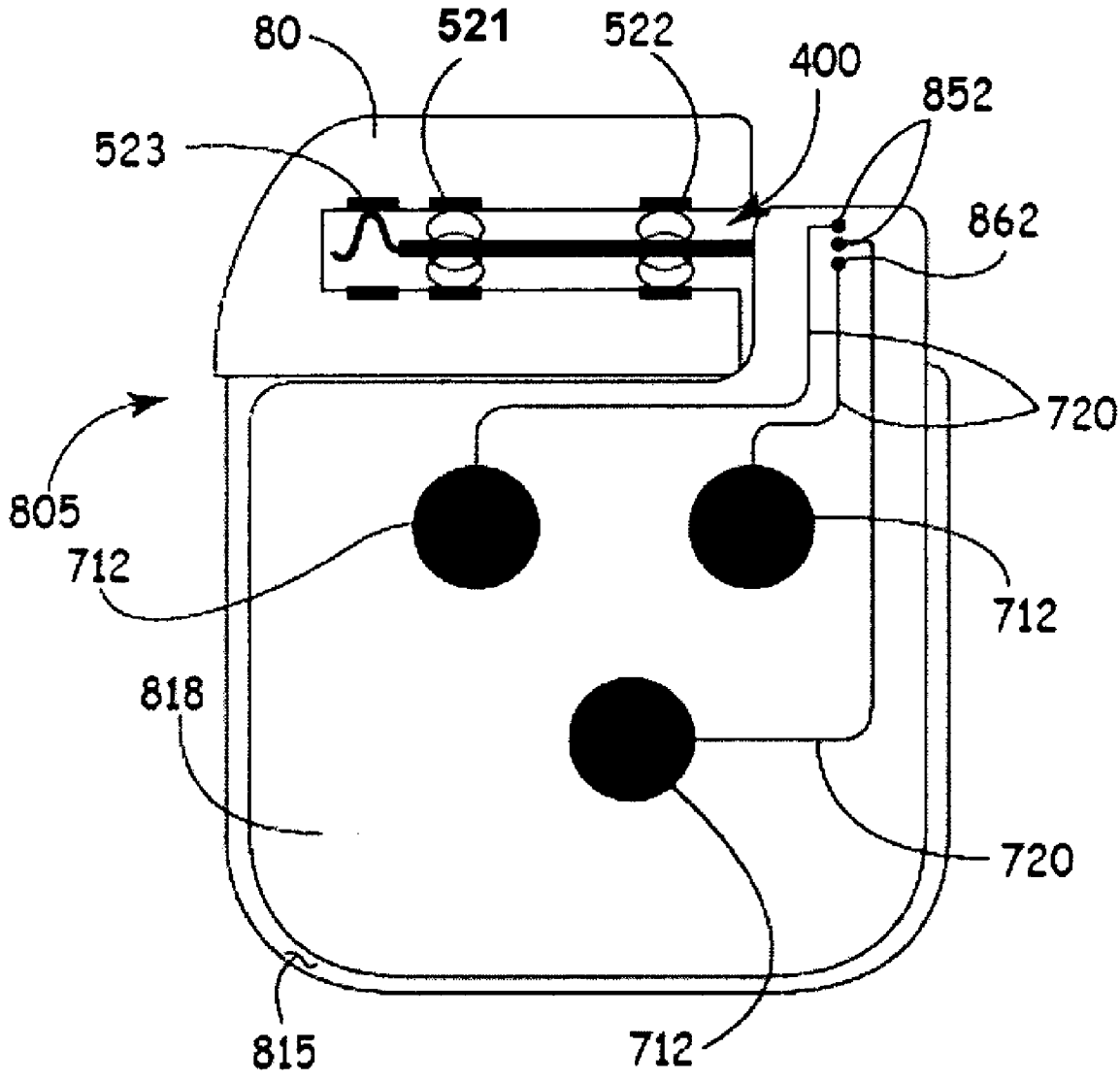
FIG. 7D is a plan view of a portion of an electrical interface, according to some alternate embodiments of the present disclosure.

FIG. 7D is a plan view of a portion of an electrical interface, according to some alternate embodiments, which includes a connective interface 818 coupled to electrical interface 400, which interface 400 was previously described in conjunction with FIGS. 4A-C. FIG. 7D illustrates interface 400 electrically coupled to a device 805 (schematically shown via a cut-away section through a connector module 80 of device 805), and connective interface 818 including contact surfaces 852 and 862, which are electrically coupled to contact surfaces 452 and 462, respectively, of interface 400 (see FIG. 4A). According to the illustrated embodiment, like connective interface 718, conductive leads 720 of interface 818 couple each of contact surfaces 852, 862 to a corresponding contact surface 712, and contact surfaces 712 are positioned to be 'sandwiched' between a surface 815 of device 805 and lid 708 of package 70 in order to mate with contact surfaces 73, which are formed on lid 708 (FIG. 7A).

Figure 8A:
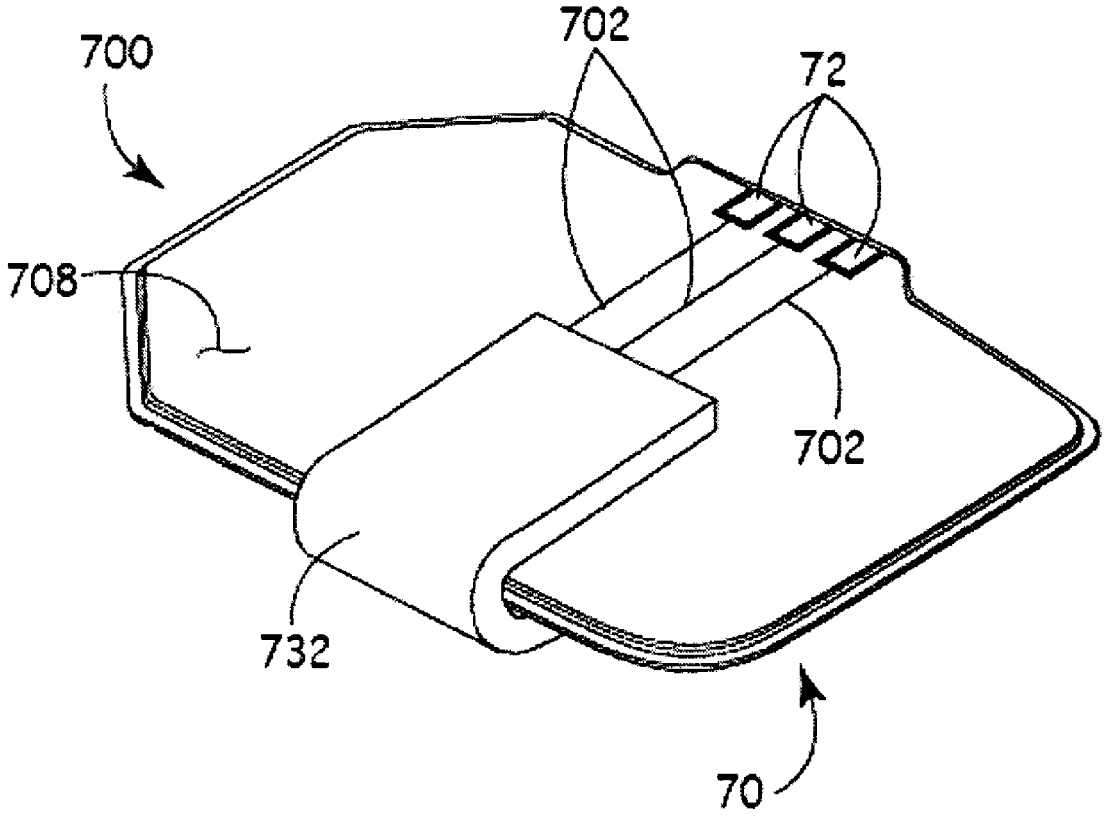
FIG. 8A is a perspective view of a system, according to an additional embodiment.

FIG. 8A is a perspective view of system 700 including a holding accessory 732, according to yet further embodiments of the present disclosure. FIG. 8A illustrates accessory 732 clamped onto package 70, over contact surfaces 73 (FIG. 7A), so as to apply pressure to maintain a stable electrical coupling between each contact surface 73 and the corresponding contact surface within package 70. The corresponding contact surfaces may be ends 501, 571, 601 of connector portions (FIG. 7A), or contact surfaces 712 of either of connective interfaces 718, 818 (FIGS. 7B-D).

Figure 8B:
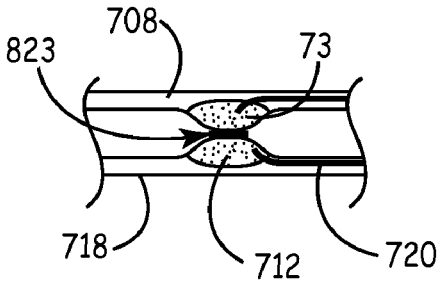
FIGS. 8B-C are section views of alternate embodiments of a coupling interface for some electrical interfaces of the present disclosure.
Figure 8C:
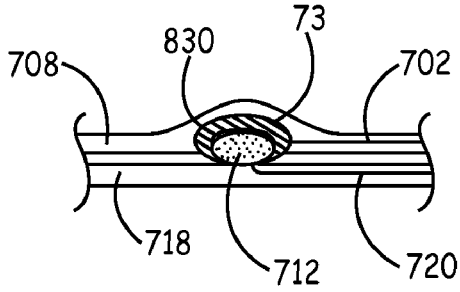

FIGS. 8B-C are section views of alternate embodiments of a coupling interface between one of contact surfaces 73 and one of contact surfaces 712, each of which may serve to maintain a stable electrical coupling therebetween, for example, without a need for accessory 732 of FIG. 8A. FIG. 8B illustrates a conductive adhesive 823 located between contact surface 73 and contact surface 712 to adhere surfaces 73, 712 to one another. Conductive adhesive 823 is preferably formulated to have a relatively weak peel strength so that when lid 708 is peeled back from tray 180, the surfaces 73, 712 may be easily separated from one another without dislodging device 705, 805 from tray 180, prior to taking device 705, 805 out from tray 180 and into the sterile field. A suitable example of such a conductive adhesive is 3M™ 9703 Z-axis electrically conductive adhesive tape, or 3M™ 9713 XYZ-axis tape. FIG. 8C illustrates contact surface 73 formed in a recessed portion 830 of lid 708, and contact surface 712, which protrudes from a surrounding surface of first segment 781 of interface 718 to interlock with surface 73 within recess 830. Such an interlock may also be easily separated when lid 708 is peeled back.

In the foregoing detailed description, the disclosure has been described with reference to specific embodiments. However, it may be appreciated that various modifications and changes can be made without departing from the scope of the disclosure as set forth in the appended claims.

The invention claimed is:

1. An electrical interface configured for coupling an electrical contact of a first medical device, contained within a package, to a second medical device, located outside the package, the electrical contact of the first device being located within a bore of a connector module of the first device, and the electrical interface comprising:

a connector structure supporting a first contact surface of the interface for electrical coupling with the electrical contact of the first device, within the bore of the connector module of the first device, while allowing passage of a sterilizing gas into the bore of the connector module and past the electrical contact of the first device, within the bore;

a substrate on which a second contact surface of the interface is mounted for electrical coupling with the second medical device; and a conductive lead coupling the first contact surface to the second contact surface.

2. The interface of claim 1, wherein the conductive lead comprises a pin member extending distally from the first contact surface, a conductive trace extending over the substrate, and a connective interface coupling the pin member to the conductive trace.

3. The interface of claim 2, wherein the connective interface comprises an aperture extending through the substrate, the aperture including a conductive lining coupled to the conductive trace and being sized to engage a distal end of the pin member.

4. The interface of claim 1, wherein:

the conductive lead comprises a first segment, which extends distally from the first contact surface, and a second segment, which extends along the substrate; and the first segment has a length so as to extend out from the bore of the connector module, when the first contact surface is electrically coupled to the electrical contact of the first device.

5. The interface of claim 1, wherein the second contact surface is located outside the package to connect with the second medical device, and a portion of the conductive lead extends through a seal of the package.

6. The interface of claim 1, further comprising:

a third contact surface and a fourth contact surface, each of the third and fourth contact surfaces being mounted on a side wall of the package; and a distal conductive lead coupling the third contact surface to the fourth contact surface and extending along the side wall of the package;

wherein the third contact surface is contained within the package, being directly coupled to the second contact surface; and the fourth contact surface is located outside the package to connect with the second medical device for electrical coupling of the second medical device to the second contact surface.

7. The interface of claim 6, wherein the second and third contact surfaces interlock with one another.

8. The interface of claim 6, further comprising a conductive adhesive adhering the second and third contact surfaces to one another.

9. The interface of claim 1, wherein the connector structure comprises a curved beam that extends through an apex, from a first end thereof to a second end thereof, the beam including the first contact surface located at the apex thereof, the apex being located in proximity to a sidewall of the connector module bore, when the first contact surface couples with the electrical contact of the first device, such that a space is provided between the apex and the sidewall to allow for the passage of the sterilizing gas.

10. The interface of claim 9, wherein the first contact surface comprises a conductive trace extending over the curved beam.

11. The interface of claim 9, wherein the first contact surface is an integral portion of the curved beam.

12. The interface of claim 9, wherein the conductive lead comprises a pin member extending distally from the first contact surface, a conductive trace extending over the substrate, and a connective interface coupling the pin member to the conductive trace.

13. The interface of claim 9, wherein:

the conductive lead comprises a first segment, which extends distally from the first contact surface, and a second segment, which extends along the substrate; and the first segment has a length so as to extend out from the bore of the connector module, when the first contact surface is electrically coupled to the electrical contact of the first device.

14. The interface of claim 9, wherein the second contact surface is located outside the package to connect with the second medical device, and a portion of the conductive lead extends through a seal of the package.

15. The interface of claim 9, further comprising:

a third contact surface and a fourth contact surface, each of the third and fourth contact surfaces being mounted on a side wall of the package; and a distal conductive lead coupling the third contact surface to the fourth contact surface and extending along the side wall of the package;

wherein the third contact surface is contained within the package, being directly coupled to the second contact surface; and the fourth contact surface is located outside the package to connect with the second medical device for electrical coupling of the second medical device to the second contact surface.

16. The interface of claim 15, wherein the second and third contact surfaces interlock with one another.

17. The interface of claim 15, further comprising a conductive adhesive adhering the second and third contact surfaces to one another.

18. An electrical interface configured for coupling an electrical contact of a first medical device, contained within a package, to a second medical device, located outside the package, the electrical contact of the first device being located within a bore of a connector module of the first device, and the electrical interface comprising:

a connector structure supporting a first contact surface of the interface for electrical coupling with the electrical contact of the first device, within the bore of the connector module of the first device;

a substrate on which a second contact surface of the interface is mounted for electrical coupling with the second medical device; and a conductive lead coupling the first contact surface to the second contact surface;

wherein the connector structure comprises a curved beam that extends through an apex, from a first end thereof to a second end thereof, the beam including the first contact surface located at the apex thereof, the apex being located in proximity to a sidewall of the connector module bore, when the first contact surface couples with the electrical contact of the first device, such that a space is provided between the apex and the sidewall.

19. The interface of claim 18, wherein the first contact surface comprises a conductive trace extending over the curved beam.

20. The interface of claim 18, wherein the first contact surface is an integral portion of the curved beam.

21. An electrical interface configured for coupling an electrical contact of a first medical device, contained within a package, to a second medical device, located outside the package, the electrical contact of the first device being located within a bore of a connector module of the first device, and the electrical interface comprising:

a connector structure supporting a first contact surface of the interface for electrical coupling with the electrical contact of the first device, within the bore of the connector module of the first device;

a substrate on which a second contact surface of the interface is mounted for electrical coupling with the second medical device; and a conductive lead coupling the first contact surface to the second contact surface;

wherein the connector structure comprises a pin member including a pair of approximately flattened sides, opposing one another, and a pair of arching sides;

each approximately flattened side extends between the pair of arching sides to define a space that allows for passage of a sterilizing gas into the bore of the connector module and past the electrical contact of the first device, within the bore; and at least one side of the pair of arching sides includes the first contact surface.

22. The interface of claim 21, wherein the conductive lead comprises a segment of the pin member of the connector structure, which extends distally from the approximately flattened sides, a conductive trace extending over the substrate, and a connective interface coupling the segment of the pin member to the conductive trace.

23. The interface of claim 22, wherein the connective interface comprises an aperture extending through the substrate, the aperture including a conductive lining coupled to the conductive trace and being sized to engage a distal end of the pin member.

24. The interface of claim 21, wherein the second contact surface is located outside the package to connect with the second medical device, and a portion of the conductive lead extends through a seal of the package.

25. The interface of claim 21, further comprising:

a third contact surface and a fourth contact surface, each of the third and fourth contact surfaces being mounted on a side wall of the package; and a distal conductive lead coupling the third contact surface to the fourth contact surface and extending along the side wall of the package;

wherein the third contact surface is contained within the package, being directly coupled to the second contact surface; and the fourth contact surface is located outside the package to connect with the second medical device for electrical coupling of the second medical device to the second contact surface.

26. The interface of claim 25, wherein the second and third contact surfaces interlock with one another.

27. The interface of claim 25, further comprising a conductive adhesive adhering the second and third contact surfaces to one another.

28. A connector portion of an electrical interface, the interface configured for coupling of an electrical contact of a first medical device, contained within a package, to a second medical device, located outside the package, the electrical contact of the first device being located within a bore of a connector module of the first device, and the connector portion comprising:

a connector structure supporting a contact surface of the interface for electrical coupling with the electrical contact of the first device, within the bore of the connector module of the first device, while allowing for passage of a sterilizing gas into the bore of the connector module and past the electrical contact of the first device, within the bore; and a conductive lead having a first end and a second end, the first end coupled to the contact surface and the second end spaced apart from the first end so as to be located outside the bore of the connector module of the first device, when the contact surface is electrically coupled to the electrical contact of the first device.

29. A connector portion of an electrical interface, the interface configured for coupling of an electrical contact of a first medical device, contained within a package, to a second medical device, located outside the package, the electrical contact of the first device being located within a bore of a connector module of the first device, and the connector portion comprising:

a connector structure supporting a contact surface of the interface for electrical coupling with the electrical contact of the first device, within the bore of the connector module of the first device; and a conductive lead having a first end and a second end, the first end coupled to the contact surface and the second end spaced apart from the first end so as to be located outside the bore of the connector module of the first device, when the contact surface is electrically coupled to the electrical contact of the first device;

wherein the connector structure comprises a curved beam that extends through an apex, from a first end thereof to a second end thereof, the beam including the contact surface located at the apex thereof, the apex being located in proximity to a sidewall of the connector module bore, when the contact surface is electrically coupled to the electrical contact of the first device, such that a space is provided between the apex and the sidewall.

30. The connector portion of claim 29, wherein the contact surface comprises a conductive trace extending over the curved beam.

31. The connector portion of claim 29, wherein the contact surface is an integral portion of the curved beam.

32. A connector portion of an electrical interface, the interface configured for coupling of an electrical contact of a first medical device, contained within a package, to a second medical device, located outside the package, the electrical contact of the first device being located within a bore of a connector module of the first device, and the connector portion comprising:

a connector structure supporting a contact surface of the interface for electrical coupling with the electrical contact of the first device, within the bore of the connector module of the first device; and a conductive lead having a first end and a second end, the first end coupled to the contact surface and the second end spaced apart from the first end so as to be located outside the bore of the connector module of the first device, when the contact surface is electrically coupled to the electrical contact of the first device;

wherein the connector structure comprises a pin member including a pair of approximately flattened sides, opposing one another, and a pair of arching sides;

each approximately flattened side extends between the pair of arching sides to define a space that allows for passage of a sterilizing gas into the bore of the connector module and past the electrical contact of the first device, within the bore; and at least one side of the pair of arching sides includes the contact surface.

33. The connector portion of claim 32, wherein the conductive lead comprises a pin member extending distally from the contact surface.

34. An electrical interface comprising:

a sterile package configured to contain and maintain sterility of a first medical device, the package including a side wall, the side wall including an inner surface and an outer surface;

a connector structure supporting a first contact surface of the interface for electrical coupling with an electrical contact of the first medical device, when the first medical device is contained within the package;

a substrate on which a second contact surface of the interface is mounted;

a first conductive lead coupling the first contact surface to the second contact surface;

a third contact surface and a fourth contact surface, the third contact surface being printed or laminated directly on the inner surface of the side wall of the package, and the fourth contact surface being printed or laminated directly on the outer surface of the side wall of the package and being spaced apart, along the sidewall, from the third contact surface; and a second conductive lead coupling the third contact surface to the fourth contact surface and extending along the side wall of the package;

wherein the third contact surface is directly coupled to the second contact surface, when the substrate, on which the second contact surface is mounted, is contained within the package, along with the first medical device, and when the first contact surface, which is supported by the connector structure, is coupled to the electrical contact of the first medical device; and the fourth contact surface, being located on the exterior surface of the package, provides for electrical coupling with a second medical device that is located outside the package.

35. The interface of claim 34, wherein the second and third contact surfaces interlock with one another.

36. The interface of claim 34, further comprising a conductive adhesive adhering the second and third contact surfaces to one another.

* * * * *